US007732737B2

(12) United States Patent
Lindsay et al.

(10) Patent No.: US 7,732,737 B2
(45) Date of Patent: Jun. 8, 2010

(54) MICRO POWERED WARMING CONTAINER

(75) Inventors: Jeffrey D. Lindsay, Appleton, WI (US); Fung-Jou Chen, Appleton, WI (US); Sheng-Hsin Hu, Appleton, WI (US); Walter Reade, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 205 days.

(21) Appl. No.: 11/247,768

(22) Filed: Oct. 11, 2005

(65) Prior Publication Data

US 2007/0081803 A1 Apr. 12, 2007

(51) Int. Cl.
*H05B 7/18* (2006.01)
*B65H 1/00* (2006.01)

(52) U.S. Cl. ..... 219/385; 219/386; 219/521; 221/63

(58) Field of Classification Search ..... 219/385, 219/386, 438, 543, 469, 554; 392/392; 221/32, 221/33, 45, 135, 63; 126/265, 263.01; 429/38, 429/22, 13, 25

See application file for complete search history.

(56) References Cited

U.S. PATENT DOCUMENTS

| | | | |
|---|---|---|---|
| 3,796,186 | A | 3/1974 | Bounds et al. |
| 4,541,132 | A | 9/1985 | Long |
| 4,549,243 | A | 10/1985 | Owen et al. |
| 4,561,037 | A | 12/1985 | MacLaine et al. |
| 4,649,895 | A | 3/1987 | Yasuki et al. |
| 4,663,639 | A | 5/1987 | Owen et al. |
| 4,965,977 | A | 10/1990 | White |
| 5,121,884 | A | 6/1992 | Noakes |
| 5,184,778 | A | 2/1993 | Noakes |
| 5,222,664 | A | 6/1993 | Noakes et al. |
| 5,251,416 | A | 10/1993 | White |
| 5,626,936 | A | 5/1997 | Alderman |
| 5,810,265 | A | 9/1998 | Cornelius et al. |
| 5,895,418 | A | 4/1999 | Saringer |
| 5,927,618 | A | 7/1999 | Jefferies et al. |
| 5,932,011 | A | 8/1999 | Noakes et al. |
| 5,932,940 | A | 8/1999 | Epstein et al. |
| 6,079,634 | A | 6/2000 | Noakes et al. |
| 6,138,671 | A | 10/2000 | Noakes et al. |

(Continued)

FOREIGN PATENT DOCUMENTS

EP 1113518 A1 7/2001

(Continued)

OTHER PUBLICATIONS

English Abstract of Japan 2002-337960, published Nov. 27, 2002.

(Continued)

*Primary Examiner*—Quang T Van
(74) *Attorney, Agent, or Firm*—Dority & Manning, P.A.

(57) ABSTRACT

A warming dispenser includes a housing having a compartment. The compartment holds a plurality of sheets. A heating device is located adjacent the plurality of sheets. A micro power source is connected to the heating device to generate energy from a fuel source, wherein the heating device uses the energy to warm at least one of the sheets. The micropower source may be, for example, a micro fuel cell adapted to deliver electricity for resistive heating.

27 Claims, 6 Drawing Sheets

U.S. PATENT DOCUMENTS

| | | | | |
|---|---|---|---|---|
| 6,311,903 | B1 | 11/2001 | Gaw et al. | |
| 6,318,647 | B1 | 11/2001 | Gaw et al. | |
| 6,326,097 | B1 | 12/2001 | Hockaday | |
| 6,376,444 | B1 | 4/2002 | Hortel et al. | |
| 6,392,313 | B1 | 5/2002 | Epstein et al. | |
| 6,517,648 | B1 | 2/2003 | Bouchette et al. | |
| 6,528,766 | B1 * | 3/2003 | Parks et al. | 219/386 |
| 6,541,149 | B1 | 4/2003 | Maynard et al. | |
| 6,589,294 | B2 | 7/2003 | Hortel et al. | |
| 6,660,667 | B2 | 12/2003 | Zuckerman et al. | |
| 6,689,466 | B2 | 2/2004 | Hartmann | |
| 6,703,127 | B2 | 3/2004 | Davis et al. | |
| 6,771,045 | B1 * | 8/2004 | Keller | 320/118 |
| 6,864,010 | B1 | 3/2005 | McLean | |
| 7,022,945 | B1 * | 4/2006 | Western | 219/386 |
| 2001/0029911 | A1 | 10/2001 | Yang et al. | |
| 2002/0061954 | A1 | 5/2002 | Davis et al. | |
| 2003/0053643 | A1 | 3/2003 | Bank et al. | |
| 2004/0211189 | A1 | 10/2004 | Arnold | |
| 2005/0214628 | A1 * | 9/2005 | Pristash | 429/38 |

FOREIGN PATENT DOCUMENTS

| | | |
|---|---|---|
| JP | 54058954 | 5/1979 |
| JP | 2002-337960 | 11/2002 |
| JP | 2003-104465 | 4/2003 |
| WO | WO 9944254 | 9/1999 |
| WO | WO 0029535 | 5/2000 |
| WO | WO 2004 094906 A2 | 11/2004 |

OTHER PUBLICATIONS

English Abstract of Japan 2003-104465, published Apr. 9, 2003.
PCT International Search Report mailed Sep. 21, 2006 directed to International Application No. PCT/US2006/021359.
English language abstract of Japanese Patent No. JP54058954, published May 12, 1979.
Pacific Northwest National Library paper entitled "Microheater" ca. Jul. 21, 1999, by Drost et al.

* cited by examiner

MICRO POWERED WARMING CONTAINER

BACKGROUND OF THE INVENTION

Disposable wipes are widely used by the consuming public to clean and moisturize skin and to clean and disinfect a variety of surfaces such as kitchen counter tops. Typically, the wipes are housed in a container for use in a home, office, vehicle or the like. These containers suffer from at least two drawbacks. First, if the wipe is to be used on an infant for instance, the wipes when extracted are often cold to the touch and are uncomfortable on the infant's skin. Second, if the wipes are to be heated prior to use on the infant, the wipes must be housed in a container that is electrically connected to a power source. Such an electrically powered container is bulky and not transportable.

A device is needed in the industry, which utilizes a compact, portable power source that enables a user to transport a container of wipes device conveniently in a purse, pocket, suitcase, automobile or the like, which can be quickly activated to warm the wipes for use on human skin.

BRIEF SUMMARY OF THE INVENTION

The present invention generally provides micro powered containers for warming wipes or sheets. The warming containers utilize micro power sources that facilitate portability of the warming containers by eliminating electrical power cords in some embodiments and bulky heaters in other embodiments to provide electrical power to the warming containers. The component parts of the micro powered warming containers are generally simple and economical to manufacture, assemble and use.

As used herein, the term "controller" means a control assembly or a control used to activate a resistor, an electrostatic charger or other separate electrically powered device.

As used herein, the term "wipe" means a sheet, a tissue or the like, which is non-woven, woven, disposable, reusable, moist or wet, dry and the like.

As used herein, the term "micro power source" includes any type of micro-fuel cell, micro-gas turbine (micro engine), microheater, or their combinations, which may, for example, deliver 10 to 100 times as much energy as conventional batteries occupying the same volume. The micro power source can deliver power to devices of the present invention from about 0.2 Watts (W) to 2000 W, more particularly from about 0.5 W to gaseous fuel with oxygen. In some versions of the invention, the energy for heating the liquid is selectively applied to the portion of the wipes or sheets that will be dispensed next (e.g., the wipes or sheets at the top of a stack or otherwise nearest the removal point). In one version, the heat is generated on demand, during or shortly before dispensing of the product, such as in response to a user action indicative of a desire to dispense the products (e.g., depressing a button or opening a lid). The amount of heating (product temperature) may be determined by user-adjustable settings such as a dial to control the heat delivered from the micro power source. Further, the micro power source according to various aspects of the present invention can be readily rechargeable by simply adding fuel to an empty fuel cartridge or replacing a spent fuel cartridge as will be described in detail in the following discussion. Other advantages of the invention will be apparent from the following description and the attached drawings, or can be learned through practice of the invention.

More specifically, the micro-fuel cells according to various embodiments described herein are devices that electrochemically oxidize a fuel to generate electricity. Exemplary methods of coupling micro-fuel cells with portable electrical devices are described and shown, for example but without limitation, in U.S. Pat. No. 6,326,097 to Hockaday, which is incorporated herein by reference.

The micro-gas turbines contemplated in various embodiments herein generally include a miniature compressor that compresses incoming air to high pressure, a combustion area that burns the fuel and produces high-pressure, high-velocity gas, and a tiny turbine that extracts the energy from the high-pressure, high-velocity gas flowing from the combustion chamber, which is then converted to electricity. Examples of microturbines that convert fuel to electricity are found in U.S. Pat. No. 5,932,940 to Epstein et al. and U.S. Pat. No. 6,392,313 to Epstein et al., which are incorporated herein by reference without limitation.

The microheater used in various embodiments described herein is a microscale heating system that can be used for personal or portable heating and cooling devices. The microheater has the capability of producing up to 30 W of thermal energy per square centimeter of external combustor area and can heat a portable heater for as long as eight hours on minimal fuel. Exemplary microheater applications are described by Drost et al. in a Pacific Northwest National Laboratory paper entitled MicroHeater, ca. Jul. 21, 1999, which is incorporated herein and without limitation by reference thereto.

Another example of fuel cell technology, which can be used in various embodiments of the present invention is a hydrogen-based fuel cell system, which is available for instance but without limitation from Angstrom Power Solutions (North Vancouver, British Columbia, Canada). Such a system is described, for example, in U.S. Pat. No. 6,864,010, to McLean, which is incorporated by reference. The hydrogen-based fuel cell system uses compressed hydrogen gas in cartridges or metal hydride storage systems. A proton exchange membrane with a porous diffusion material and catalyst generates electricity from the reaction of oxygen and hydrogen, with an optional hybrid battery connected to the fuel cell. The fuel cell can be cylindrical, as in the shape of existing AA lithium batteries, or can have a prismatic shape. For example, an Angstrom V50 cylindrical fuel cell is 2.6 cosmetic in diameter and 2 cm long, producing 1 W at 5 volts. A V60 fuel cell is a prismatic fuel cell with dimensions of 5 mm×27 mm×19 mm. As presented at the 7th Annual Small Fuel Cell 2005 Conference, Washington, D.C., Apr. 27-29, 2005, Angstrom fuel cells may deliver energy of 700 Whr/liter or 170 Whr/kg at 50% net efficiency.

With particular reference to the micro-fuel cell form of a micro power source, the micro-fuel cell generates and delivers electrical power to cleaning devices very efficiently. The micro-fuel cell can be but is not limited to a polymer electrolyte membrane (PEM) cell, a direct methanol cell (DMFC—a form of PEMFC discussed below), a phosphoric acid cell, an alkaline cell, a molten carbonate cell, a solid oxide cell, and a regenerative (reversible) micro-fuel cell. Other types of micro-fuel cells may include small MEMS (micro electrical machined system) devices, which are also suitable for electrical power applications. The MEMS-based fuel cell can be a solid oxide type (SOFC), a solid polymer type (SPFC), or a proton exchange membrane type (PEMFC). Each MEMS micro-fuel cell can have an anode and a cathode separated by an electrolyte layer. Additionally, catalyst layers can also separate the electrodes (cathode and anode) from the electrolyte as discussed below.

By way of more specific example, the PEM micro-fuel cells use a membrane to separate the fuel from the oxygen. A catalyst such as platinum may be present on, in, or otherwise associated with the membrane to help generate hydrogen ions from the fuel in the presence of an electrochemical circuit that receives an electron as a hydrogen ion is generated. The membrane, typically wetted with water, allows hydrogen ions from the fuel to diffuse toward the oxygen where it reacts electrochemically. The overall reactions involved may be, in the case of methanol fuel cell:

$$CH_3OH+H_20 \rightarrow CO_2+6H^++6e^-$$

$$6H^++3/2O_2+6e^- \rightarrow 3H_20$$

The flow of electrons across the circuit occurs at a voltage that can be used to conduct useful work; i.e., to power cleaning devices as described herein.

By way of further example but not of limitation, a micro-fuel cell in another aspect of the invention can be made from two silicon substrates. Porous silicon is formed along the surface of the substrate in a desired pattern provided by a mask. Suitable mask materials include those that do not dissolve in HF, e.g., silicon nitride, gold and chromium. Ambient mask conditions are next changed to provide electropolishing to form gas delivery tunnels or channels underlying the porous regions. A variety of patterns are suitable for these tunnels or channels such as serpentine, parallel, wheel and spoke or fractal patterns. The mask provides a final structure in which the porous silicon regions are supported, typically by portions of the mask itself. The resulting structure provides porous silicon regions formed in the surface of the substrate, with underlying tunnel regions formed within the substrate.

In this exemplary micro-fuel cell, two silicon current collector/gas diffusion structures are prepared as described above. A catalyst layer is then formed on each silicon structure (on the surface in which the porous silicon regions are formed) for both electrodes. The catalyst layer is formed by any suitable technique, e.g., sputtering or spinning an emulsion of catalyst particles. The catalyst layer can be, for example, platinum or platinum/carbon (e.g., carbon particles having attached platinum particles). Additionally, a platinum/ruthenium catalyst is useful for reacting with methanol fuel, although the Pt—Ru is generally only used for the catalyst layer in contact with the fuel, with a different catalyst used on the oxidant side of the cell. The catalyst layer is electrically conductive (i.e., at least 1 $ohm^{-1}cm^{-1}$) and is in electrical contact with the silicon current collector.

On one of the foregoing substrates, a proton exchange membrane is formed on the catalyst layer. As used herein, the term "proton exchange membrane" indicates any suitable material that allows ions to conduct across it. Forming the proton exchange membrane encompasses in situ techniques such as spin or solution casting, as well as providing a pre-formed film onto the catalyst. An exemplary membrane for use in this construction is the Nafion® brand membrane sold by the Dupont® company. Specifically, the Nafion® brand membrane is a perfluorosulfuric acid membrane with a polytetrafluoroethylene backbone.

Those skilled in the art will appreciate that other films are commercially available and suitable for use as the membrane. For example but not by way of limitation, modified Nafion® brand membranes can be obtained by treatment with electron beams or chemical modification (e.g., addition of a polybenzimidazole layer applied with screen printing or other printing techniques). The membrane can also contain exfoliated clays or hydrocarbons.

The selected membrane is next formed on the catalyst layer by liquid phase techniques, e.g., spin casting or solution casting, or by assembly of a pre-cast film. The membrane thickness ranges from about 10 to about 50 μm. In the case of a pre-cast film, the catalyst material is generally painted onto the film, e.g., as an ink containing the catalyst, alcohols, and the membrane polymer.

It should be understood that there is no well-defined boundary between the catalyst layer and the membrane. For example, in the case of spin or solution casting, the catalyst layer surface generally has some texture, and casting of the membrane layer on such a textured surface causes the ionically conducting polymer to move into such textured regions, e.g., into local valleys of the catalyst layer. Painting a catalyst material onto a pre-cast membrane provides a similar result.

To finish forming the micro-fuel cell, one of the above-described electrode structures is placed on the other electrode structure such that the catalyst layer of the second substrate contacts the proton exchange membrane. Generally, a PTFE or solubilized form of the proton exchange membrane is used to bond the catalyst layer to the membrane, followed by a heat treatment to drive off alcohol and solvents.

As constructed above, the micro-fuel cell operates as follows: fuel, e.g., hydrogen or methanol, is introduced into the first current collector (the anode) by directing the fuel through the tunnels such that it diffuses through the porous gas-diffusion regions to the catalyst layer. The catalyst layer promotes formation of hydrogen ions from the fuel, releasing electrons. The electrons flow from the catalyst layer through the anode current collector and through an external circuit, while the hydrogen ions (i.e., protons) move across the membrane toward the second catalyst layer (the cathode catalyst).

In this micro-fuel cell, an oxidant, e.g., air or oxygen, is directed into the tunnels of the cathode current collector, and diffuses through the gas-diffusion porous regions to the second catalyst layer. At this second catalyst layer, oxygen from the oxidant reacts both with the hydrogen ions flowing across the membrane and with the electrons flowing to the catalyst layer from the external circuit to form water. As noted above, this electron flow provides the desired current, and the water by-product is removed from the cell.

With reference now to the direct methanol fuel (DMFC) cell briefly introduced above, an exemplary DMFC cell includes a 13 W fuel cell operating at 15V that can operate for about 10 hours on approximately 100 ml of fuel. Another exemplary DMFC is thumb-sized: about 22 mm×about 56 mm×about 4.5 mm with 1.6 g of methanol fuel in its tank and has an overall mass of about 8.5 g. This micro-fuel cell provides about 20 hours of power at 100 mW for operation of, for example, a heating device using just 2 cc of fuel.

By way of further example, an active micro-fuel cell can provide 1 W of power for about 20 hours with approximately 25 cc of fuel. With the 25 cc methanol fuel cartridge in place, its weight is only about 130 g, with a size of about 100 mm×about 60 mm×about 30 mm (about 140 cc volume). This is equivalent to 6 lithium-ion batteries (3.7V and 600 mAh) that are currently used, for instance, in cellular phones By way of further example, Los Alamos National Laboratory (LANL) at Los Alamos, New Mexico has developed micro-fuel cells such as a 100 $cm^2$ fuel cell for the U.S. Department of Energy and a 19.6 $cm^2$ fuel cell (250 g, 340 W/kg, 25 W nominal and 75-85 W peak power).

Many of the foregoing exemplary micro-fuel cells can use a variety of fuels, e.g., ethyl alcohol, methanol, formic acid, butane, or other fuel sources to produce electrical power. The skilled artisan will instantly recognize that the fuels need not be methanol or other volatile fuels, but can also be non-volatile such as the borohydride—alkaline solutions combined with alcohols provided by Medis Technologies of New York City, N.Y.

A variety of solid oxide fuel cells (SOFCs) can also be used as the micro-fuel cells. In an SOFC, a solid oxide electrolyte is used in combination with a compatible anode and a cathode material. Such an SOFC generates electricity and heat by directly converting the chemical energy of a fuel (hydrogen, hydrocarbons) with an oxidant ($O_2$, air) via an electrochemical process. The SOFC makes use of the property of certain solid-state oxide electrolytes to support a current of oxygen anions; for example, stabilized zirconia or related oxygen-ion conductors.

Also in the SOFC, the electrolyte membrane separates the fuel and oxidant with the cathode side in contact with the oxidant and the anode side in contact with the fuel. Oxygen from the oxidant stream is reduced to $O^{2-}$ anions at the cathode. These anions are transported through the solid electrolyte to the anode side of the cell. At the anode, the $O^{2-}$ ions are reacted with the fuel stream thus releasing electrons to flow back to the cathode. A secondary cleaning device in accordance with certain aspects of the present invention can be inserted into the circuit between the anode and cathode to draw useful work from the flow of electrons generated.

In addition to the above-described micro-fuel cells, other fuel cell technologies are suitable for use in various embodiments of the present invention. For example, a methanol fuel cell is available from CMR Fuel Cells, Ltd. of Harston, Cambridge, United Kingdom, which does not require the flow plates used by some fuel cells (compare SOFC above) to keep the fuel and the oxygen separated; i.e., the CMR fuel cell allows operation with mixed fuel and oxygen. Yet other suppliers of micro-fuel cells include Smart Fuel Cell GmbH of Germany, Samsung of South Korea and Microcell of Raleigh, N.C. In particular, the Microcell-PE methanol fuel cells are useful for powering portable devices requiring sub-watt to 100 W power.

When electricity is produced by a micropower device, it need not be used exclusively for heating, but may also operate other devices such as electrically powered sensors and sensor display screens (e.g., an LCD screen showing temperature of the wipe to be dispensed), sound devices, fragrance delivery devices, timers, automated dispensing devices such as a roller that delivers a wipe for easier removal, and so forth.

In light of the above exemplary micro power sources, according to a particular aspect of the invention, a micro powered warming dispenser includes a housing defining a compartment therein, the compartment being configured to hold a plurality of sheets; a heating device disposed proximate the plurality of sheets; and a micro power source in communication with the heating device, the micro power source being configured to generate energy from a replaceable fuel source in communication with the micropower source, the heating device being configured to deliver the energy for warming at least one of the sheets. In this aspect, the sheets can be a tissue, a wipe, a non-woven polymer material, an airlaid material, and combinations of these and other materials known in the industry. The sheets can also be wet sheets, dry sheets, treated sheets, and combinations thereof.

Also in this aspect of the invention, the heating device can be a plate adapted for selectively heating the sheets disposed proximate the plate. The plate can have a plurality of resistor elements attached thereto, the micropower source configured to deliver electricity to the resistor elements for resistive heating to heat the plate. A hinge assembly can be provided to connect a portion of the plate to a complementary portion of the compartment, the hinge assembly being configured to rotate the plate away from the at least one heated sheet for removal of the heated sheet by a user.

In this aspect, the micro power source can generate about 0.2 W to about 200 W. The supply of fuel can generate an electrochemical reaction to generate the energy. The micro power source can include a fuel cell having a fuel cartridge and a combustion chamber, the fuel cartridge being configured to hold a supply of fuel, the combustion chamber being configured to receive and combust the fuel to generate the energy. The fuel cartridge can be refillable with a replacement supply of fuel, and/or the fuel cartridge can be a replaceable fuel cartridge. Additionally, or alternatively, the micro power source can include a microturbine engine including a plurality of diffuser vanes and a plurality of compressor blades, the plurality of compressor blades being configured for rotation about the diffuser vanes to generate the energy.

Also in this aspect of the invention, the micro powered warming dispenser can include a controller in communication with the micro power source, the controller being configured to activate the micro power source to generate the energy. The controller can be a conductivity contact configured to activate the micro power source by a user touch.

Further, in this aspect the warming dispenser can include an indicator configured to alert the user to a status of the micro power source. The indicator can also alert the user to a temperature of the heating device.

In another aspect of the invention, a warming dispenser can include a housing defining a compartment therein, the compartment being configured to hold a plurality of sheets; a heating plate disposed proximate the plurality of sheets; and a micro power source in communication with the heating plate, the micro power source being configured to generate energy, the heating plate having a plurality of resistor elements therein being configured to convert the energy to heat for warming at least one of the sheets, the heating plate being configured for removal from the compartment to access the at least one heated sheet. The sheets in this aspect can be a tissue, a wipe, a non-woven polymer material, an airlaid material, and combinations thereof. Moreover, the sheets can be wet sheets, dry sheets, treated sheets, and combinations thereof.

The micro powered warming dispenser can also include a hinge assembly connecting a portion of the plate to a complementary portion of the compartment, the hinge assembly being configured to rotate the plate away from the at least one heated sheet for removal of the heated sheet by a user. The warming dispenser can further include a lid attached to the housing configured to cover the heating plate.

The micro power source in this aspect of the invention can generate about 0.2 W to about 200 W. The micro power source can include a fuel cell having a fuel cartridge and a combustion chamber, the fuel cartridge being configured to hold a supply of fuel, the combustion chamber being configured to receive and combust the fuel to generate the energy. The supply of fuel can generate an electrochemical reaction to generate the energy. In this aspect, the fuel cartridge can be refillable with a replacement supply of fuel and/or the fuel cartridge can be a replaceable fuel cartridge.

Additionally, or alternatively, the micro power source in this aspect can be a microturbine engine including a plurality of diffuser vanes and a plurality of compressor blades, the plurality of compressor blades being configured for rotation about the diffuser vanes to generate the energy.

Also in this aspect of the invention, the micro powered warming dispenser can include a controller in communication with the micro power source, the controller being configured to activate the micro power source to generate the energy. The controller can be a conductivity contact being configured to activate the micro power source by a user touch.

Further in this aspect the micro powered warming dispenser can include an indicator being configured to alert the user to a status of the micro power source. The indicator can alert the user to a temperature of the heating plate.

In yet another aspect of the invention, a warming dispenser can include a housing defining a compartment therein, the compartment being configured to hold a plurality of sheets; a heating nozzle disposed proximate the plurality of sheets; and a micro power source in communication with the heating nozzle, the micro power source being configured to generate energy from a replaceable fuel source, the heating nozzle being configured apply the energy for warming at least one of the sheets as the at least one sheet passes through the heating nozzle. The sheets can be a tissue, a wipe a non-woven polymer material, an airlaid material, and combinations thereof. Moreover, the sheets can be wet sheets, dry sheets, treated sheets, and combinations thereof.

Also in this aspect of the invention, the micropower source delivers energy from oxidation of the fuel, and the heating nozzle defines a channel therein having a plurality of resistor elements attached about the channel, the resistor elements being configured to generate heat from the energy to heat the at least one sheet. The micro power source can generate about 0.2 W to about 200 W. The micro power source can include a fuel cell having a fuel cartridge and a combustion chamber, the fuel cartridge being configured to hold a supply of fuel, the combustion chamber being configured to receive and combust the fuel to generate the energy. In this aspect, the supply of fuel is adapted for generating an electrochemical reaction to generate the energy. The fuel cartridge is configured to be refillable with a replacement supply of fuel and/or the fuel cartridge is a replaceable fuel cartridge.

Also in this aspect of the invention, the micro power source can include a microturbine engine including a plurality of diffuser vanes and a plurality of compressor blades, the plurality of compressor blades being configured for rotation about the diffuser vanes to generate the energy.

In this aspect, the warming dispenser can include a controller in communication with the micro power source, the controller being configured to activate the micro power source to generate the energy. The controller can be a conductivity contact being configured to activate the micro power source by a user touch.

The warming dispenser can also include an indicator being configured to alert the user to a status of the micro power source. The indicator can be configured to alert the user to a temperature of the heating channel.

Further, in this aspect of the invention, the warming dispenser can include a material chamber in communication with the micro power source, the material chamber being configured to hold a phase change material for release onto the at least one sheet, the phase change material being configured to retain the heat from the heating nozzle in the at least one sheet when the sheet is withdrawn from the compartment through the heating nozzle.

Other aspects and advantages of the invention will be apparent from the following description and the attached drawings, or can be learned through practice of the invention.

BRIEF DESCRIPTION OF THE DRAWINGS

The above and other aspects of the present invention will be apparent from the detailed description below and in combination with the drawings in which.

DETAILED DESCRIPTION OF THE INVENTION

Figure 1:
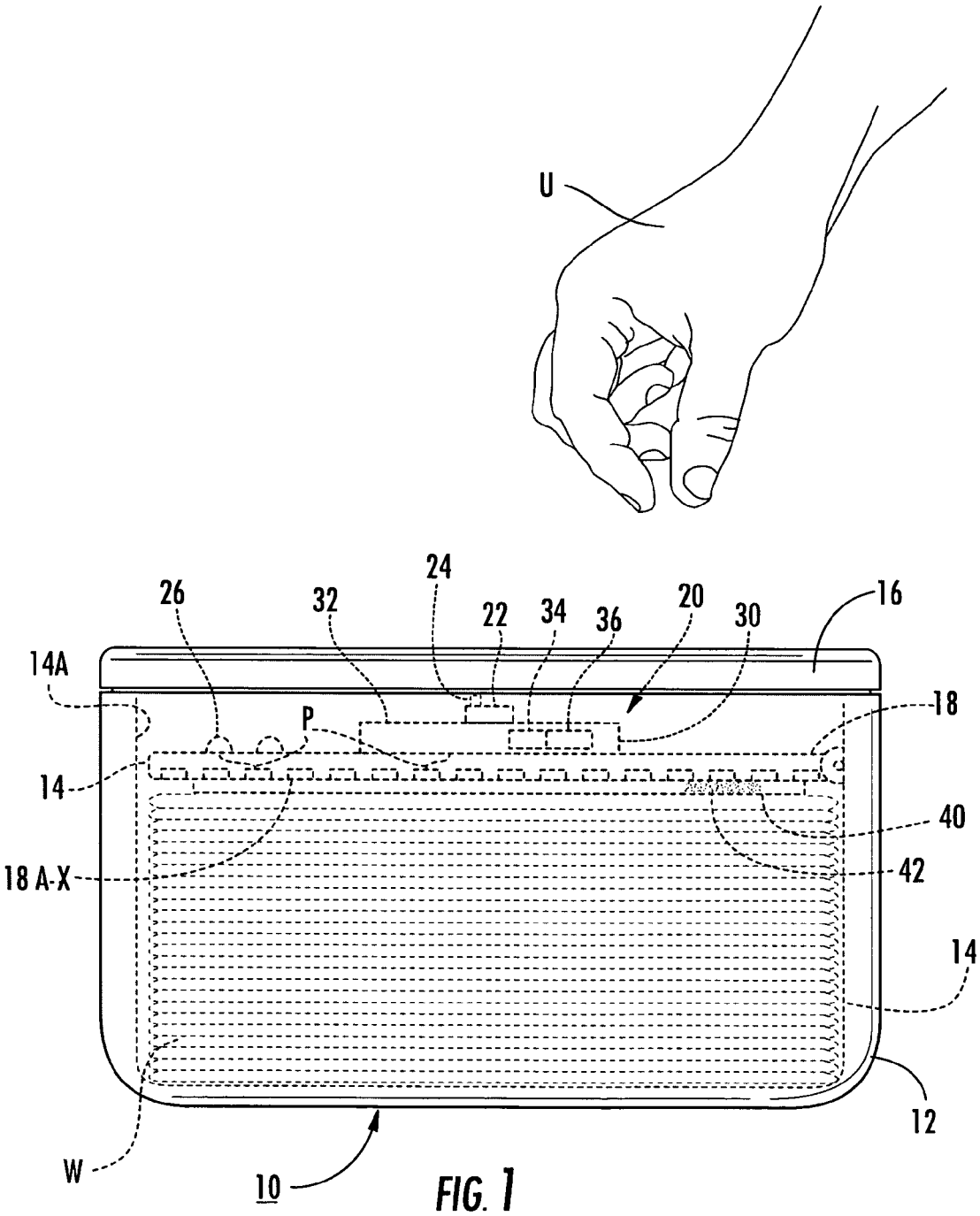
FIG. 1 is an elevational view of a dispenser powered by a micro power source shown in phantom according to one embodiment of the invention.

Detailed reference will now be made to the drawings in which examples embodying the present invention are shown. The detailed description uses numerical and letter designations to refer to features of the drawings. Like or similar designations in the drawings and description have been used to refer to like or similar parts of the invention.

The drawings and detailed description provide a full and detailed written description of the invention and the manner and process of making and using it, so as to enable one skilled in the pertinent art to make and use it. The drawings and detailed description also provide the best mode of carrying out the invention. However, the examples set forth in the drawings and detailed description are provided by way of explanation of the invention and are not meant as limitations of the invention. The present invention thus includes any modifications and variations of the following examples as come within the scope of the appended claims and their equivalents.

As broadly embodied in the figures, a warming container employing a micro power source is provided. The warming container is used for warming a disposable or reusable wipe or sheet such as for skin comfort. The skilled artisan will instantly recognize that the warming container and its components including materials, combinations and dimensions, which are described in detail below, are modifiable to accommodate various container and environment requirements and are not limited to only those examples shown in the figures.

Turning now to FIG. 1, a first embodiment of a warming container is designated in general by the element number 10. The warming container 10 (alternatively, tub or dispenser) includes a body or housing 12, a reservoir or compartment 14, a lid or cap 16, a heating device or resistor plate 18 and a micro power source 20. The micro power source 20 in this aspect of the invention includes a microfuel cell 30, which has a combustion or reaction chamber 32 and a fuel cartridge 34 for storing a quantity of fuel 36. Although shown substantially level in this example, the fuel cartridge 34 may be disposed at a higher elevation than the reaction chamber 32 during normal use in order to permit gravitational feed of the fuel 36 to the reaction chamber 32, if desired. Micro pumps, capillary pressure, or other devices or methods can also be used to deliver the fuel in other embodiments. Further details of the microfuel cell 30, its components and operation are provided in detail below.

As shown in FIG. 1, the housing 12 includes a plurality of wipes W. In this example, the wipes W are interfolded moist wipes, which are pre-warmed by the heating plate 18. As shown, the heating plate 18 includes a plurality of resistor elements 18*a-x* (where x indicates a theoretically endless number of resistors, resistor elements, wires or the like). The heating plate 18 is seated on at least one of the wipes W.

Therefore, in this example, a topmost wipe W is heated by the heating plate 18 to a temperature that is comfortable for use on human skin, although the wipe W can be heated to various higher temperatures such as for cleaning kitchen counter surfaces. More specifically, the heating plate 18 can be coextensive with the underlying wipes W, but need not contact the entire available surface area of the adjacent wipe W. For example, the contact area may be a fraction of the available surface area of the adjacent wipe W, such as less than about 90%, less than about 80%, from about 50% to about 85%. The heating plate material in contact with the wipes W may be metallic, such as aluminum, copper, steel, or alloys thereof, and may be solid, porous, or in the form of a wire mesh.

As FIG. 1 further shows, the heating plate 18 can rest on the wipes W and be removed from the compartment 14 when an indicator 26 indicates that the topmost wipe W has reached a desired temperature and is ready for removal. Alternatively, the heating plate 18 can be attached to a wall 14*a* of the compartment 14 by way of a hinge assembly 28. The hinge assembly 28 can be a detent arrangement or a simple swivel arrangement as known to those skilled in the art. Therefore, further details of the hinge assembly 28 are not necessary for the skilled artisan to appreciate and practice this aspect of the invention.

The indicator 26 briefly introduced above can be a light, an LED or an audible alarm that will indicate to a user U that the topmost wipe W has reached the optimal temperature. As shown in FIG. 1, the indicator 26 is connected to the resistor elements 18*a-x*, which in turn are connected to the micro power source 20 via a plurality of electrical power lines P. For the sake of clarity, only one line P is represented in FIG. 1. Also shown, the indicator 26 can be a plurality of indicators that indicate whether the resistor elements 18*a-x* are warming, ready or off. The skilled artisan will instantly recognize that the indicator 26 can be installed elsewhere on the container 10 such as on an external surface of the housing 12 or the lid 16 and is not limited to the exemplary placement shown.

FIG. 1 further shows an encapsulated phase change material (EPCM) chamber 40. The EPCM chamber 40 can be attached to the heating plate 18 as shown but can be positioned elsewhere in the compartment 14. As shown, the EPCM chamber 40 is electrically connected to the power source 20 via the power lines P. The EPCM chamber 40 holds a plurality of encapsulated phase change materials (PCM) 42 such as in the form of gelatin beads that are heat activated. The PCM 42 is optional additive for wipes W to help maintain their temperature. Specifically, the PCM 42 has the capability of absorbing or releasing thermal energy to reduce or eliminate heat transfer at the temperature stabilizing range of the particular temperature stabilizing material. The PCM 42 inhibits or stops the flow of thermal energy through the material during the time the PCM 42 is absorbing or releasing heat, typically during the material's change of phase. This action is transient, i.e., it will be effective as a barrier to thermal energy until the total latent heat of the temperature stabilizing materials is absorbed or released during the heating or cooling process. Thermal energy may be stored or removed from the phase change material, and can effectively be recharged by a source of heat or cold. Two or more different phase change materials can be used to address particular temperature ranges and such materials can be mixed.

By way of example operation, as the power source 20 elevates a temperature to about 95 to about 115 degrees Fahrenheit, the gelatin capsules of the PCM 42 can melt to release the encapsulated phase change materials 42 at least onto the topmost wipe W. As discussed above, the PCM 42 will coat the topmost wipe W to retain at least some residual heat from the resistor elements 18*a-x* after the PCM 42-conditioned wipe W has been withdrawn from the compartment 14. Accordingly, the wipe W can be used, for instance, to bathe an infant at a comfortable temperature level for an extended period of time such as about 2 minutes to about 5 minutes.

With continued reference to FIG. 1, a controller 22 is shown having an on/off mechanism 24, which can be used to activate the micro power source 20. The on/off mechanism 24 can be a toggle or button-type switch, or it can be a conductivity contact that the user U touches to complete an electrical circuit to energize the micro power source 20 and the resistor elements 18*a-x*. The micro power source 20 can be on a timed circuit such that after a predetermined number of minutes, the micro power source 20 will deenergize to avoid overheating the resistor elements 18*a-x*, or unnecessarily depleting the fuel 36. Alternatively, the controller 22 can be a voltage controller in the form of a dial or other means to adjust the power applied to the wipe (or its target temperature) for user control beyond simply turning the device on or off.

Figure 2:
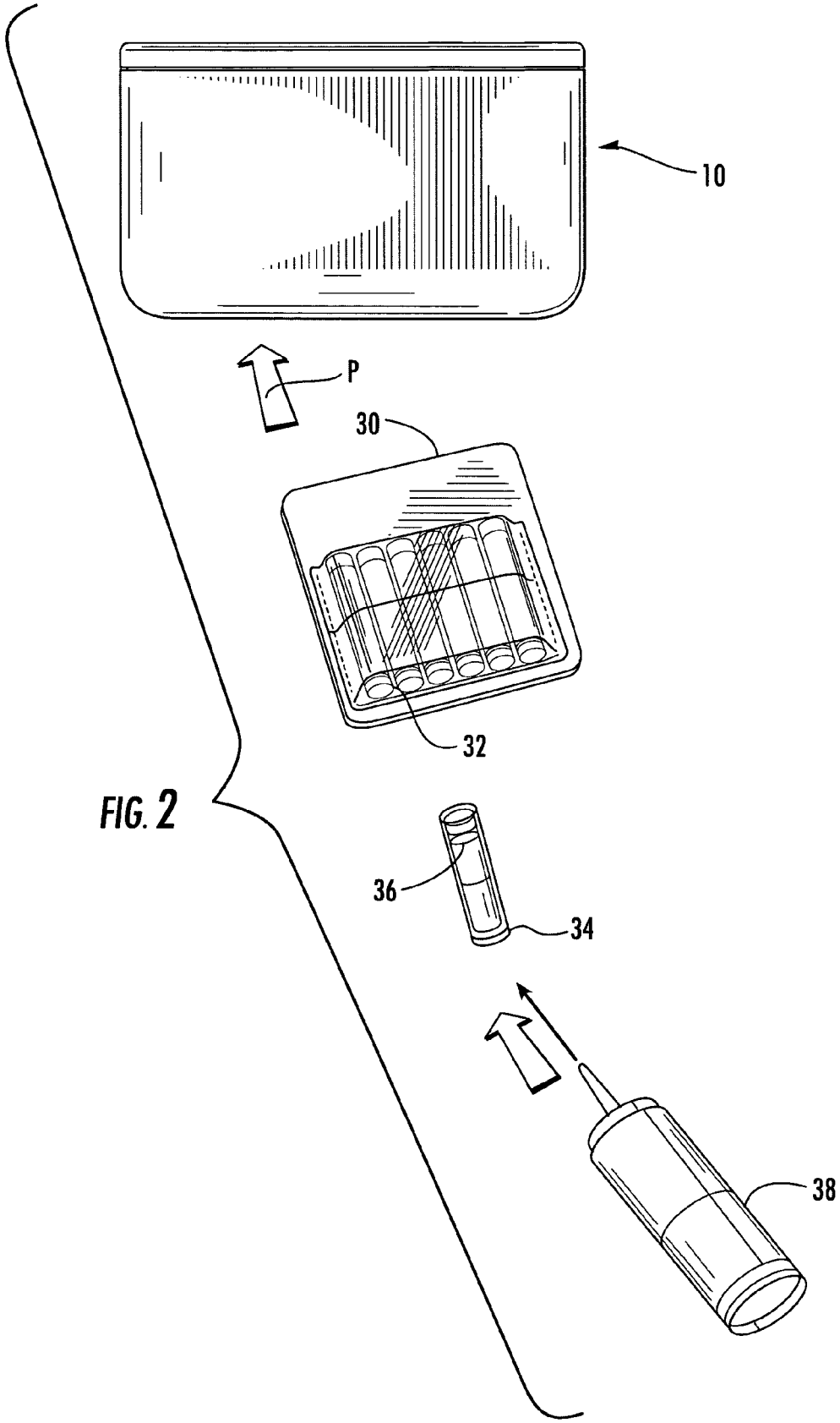
FIG. 2 is an exploded view of a reusable micro power source being inserted in a dispenser as in FIG. 1 according to an aspect of the invention.

Turning now to FIG. 2, the microfuel cell 30 is shown in greater detail. In this aspect of the invention, the microfuel cell 30 includes the reaction chamber 32 and the fuel cartridge 34 briefly introduced with respect to FIG. 1 above. As shown, the fuel cartridge 34 holds the fuel 36, which upon activation of the on/off mechanism 24, for instance, will deliver the fuel 36 into the reaction chamber 32 for combustion. More particularly, the fuel 36 undergoes an electrochemical reaction in this aspect of the invention in which electrons are transferred in a manner to create the electricity as described in greater detail with respect to FIG. 3 below. The electricity is delivered to the various components described above via the electrical lines P. As further shown in FIG. 2, the fuel cartridge 34 can be refilled with a subsequent quantity of fuel 36 using a refueling device 38, or the fuel cartridge 34 can be removed and replaced in its entirety with a new fuel cartridge after the fuel 36 is depleted from the original fuel cartridge 34.

Figure 3:
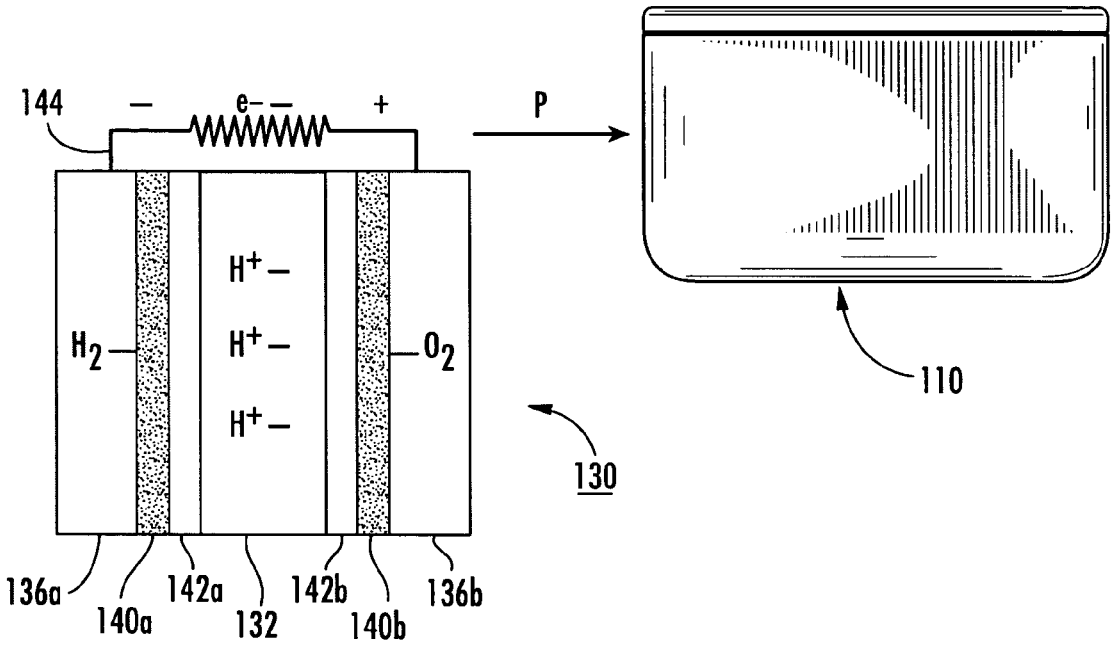
FIG. 3 is a schematic diagram of a micro fuel cell as used in a dispenser according to an aspect of the invention.

With reference to FIG. 3, an alternative embodiment of a microfuel cell 130 is shown, which can power a warming container 110 similar to the warming container 10 as discussed above, or a warming container 310 as will be described with respect to FIG. 6 below. As shown in FIG. 3, the microfuel cell 130 is "sandwiched" together to serve as a gas delivery structure for a fuel, for example hydrogen gas $H_2$, and for an oxidant (e.g., $O_2$). More particularly, the microfuel cell 130 contains an anode current collector 136A and a cathode current collector 136B, which can both be formed, for instance, from a graphite block with machine paths thereon (not shown) for directing the fuel or the oxidant. In this aspect, graphite cloths 140*a,b* are provided to allow for gas diffusion from the current collectors 136A,B to a centrally located proton exchange membrane 132 having catalyst films 142A,B formed on each side of the exchange membrane 132. In this example, platinum is used to form the catalyst films 142A,B.

As indicated in FIG. 3, the hydrogen gas fuel $H_2$ moves through the machine paths in the anode current collector 136A, diffuses through the graphite cloth 140*a* and contacts the catalyst layer 142A. The catalyst strips electrons $e^-$ from the fuel $H_2$, and the electrons $e^-$ then travel through an external circuit 144. The remaining positive ions $H^+$ travel through the membrane 132 to the second catalyst layer 142B where they combine with oxygen ions formed when the free electrons $e^-$ travel from the circuit 144 and combine with the oxidant fed through the machine channels of the cathode current collector 136B. One byproduct of this process is electricity generated by the electron flow. Similar to the embodiment above, the electricity in this example is connected to and powers the warming container 110 via the power line P. Other byproducts of the process are heat and water, which can be recirculated, for instance, into the wipes W as described above in regard to FIG. 1.

Figure 4:
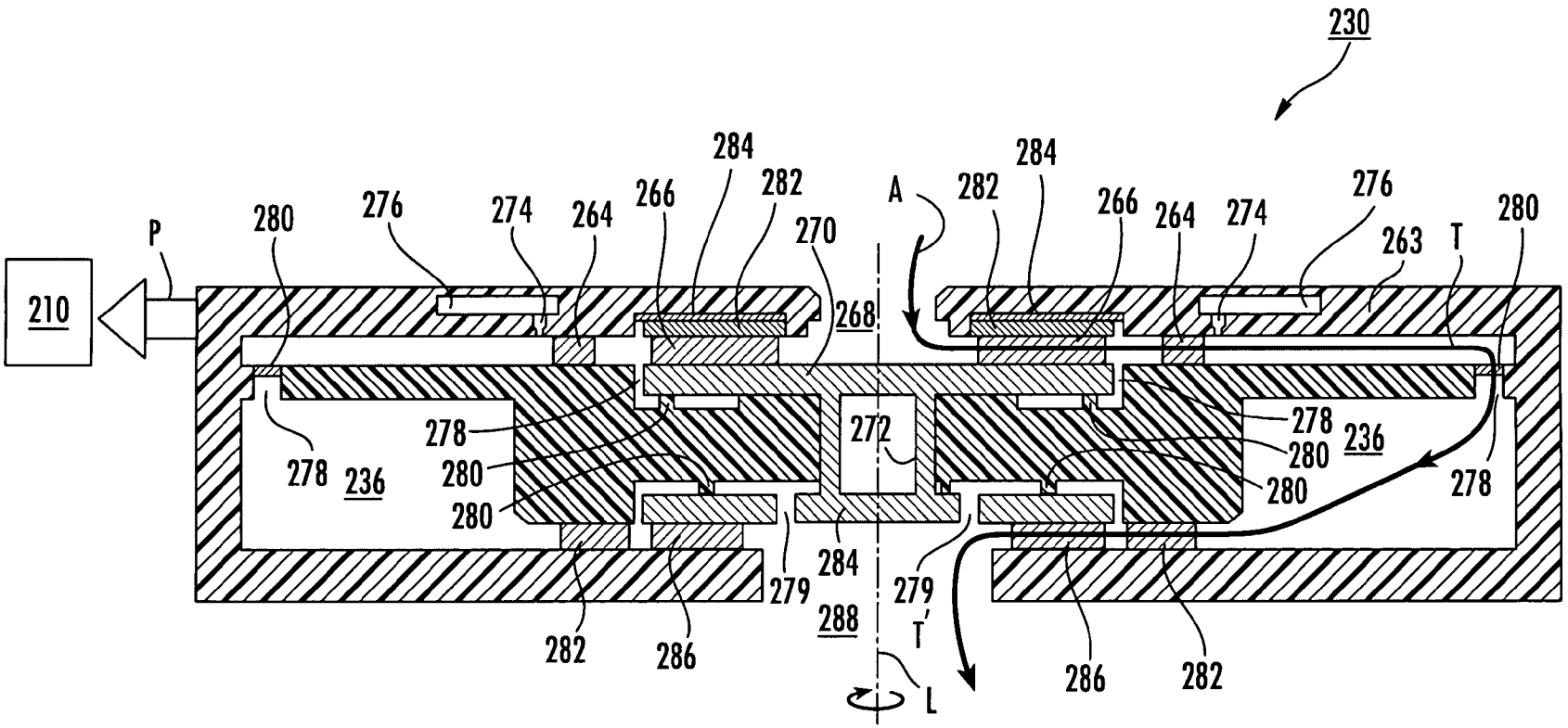
FIG. 4 is a cross sectional, elevational view of a micro power source as used in a dispenser in accordance with another aspect of the invention.
Figure 5:
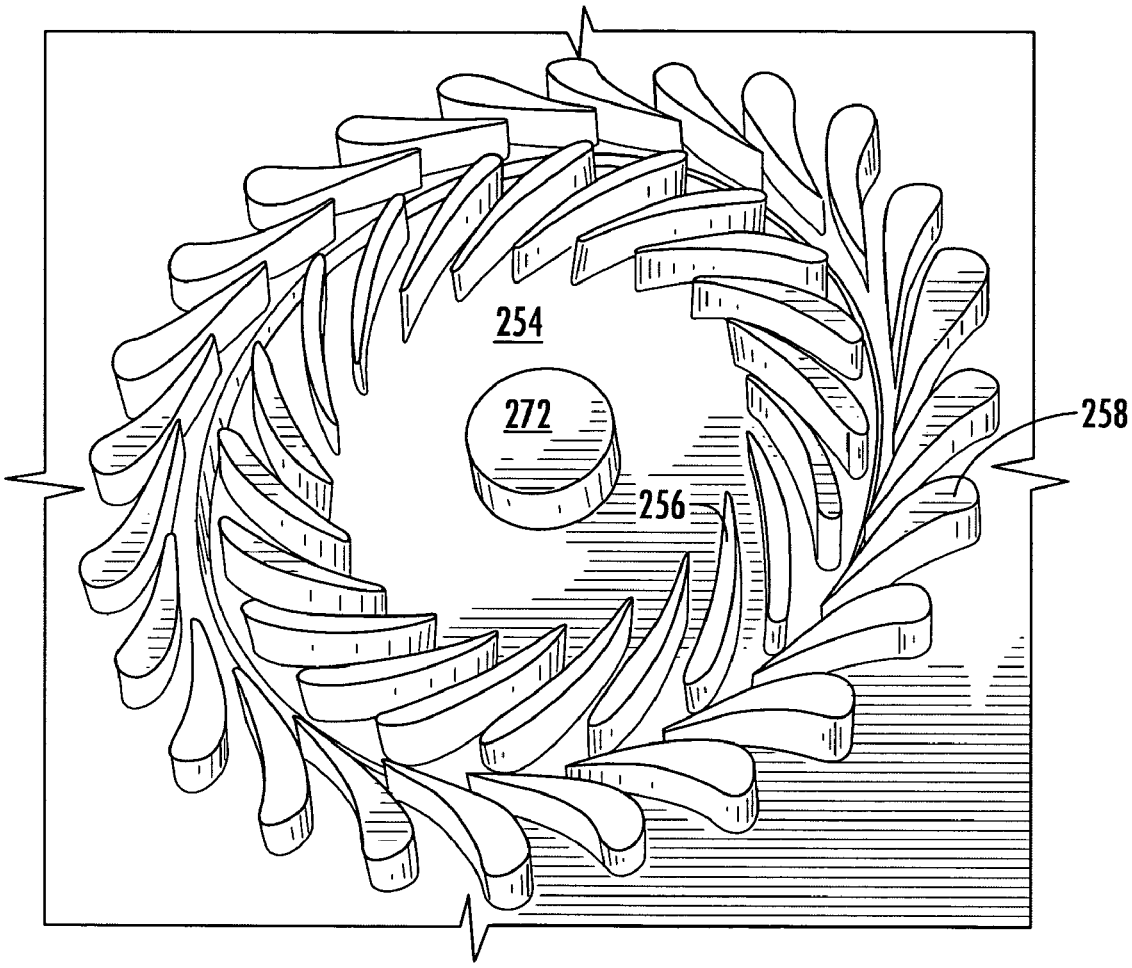
FIG. 5 is a top perspective view of a microturbine as used in the micro power source of FIG. 4.

Turning now to FIGS. 4 and 5, an alternative embodiment of micro powered warming container is shown, generally designated by the number 210, which is similar to the containers discussed above. A micro gas turbine engine or microengine 230 is employed in the warming container 210. The microengine 230 generally includes a plurality of fixed diffuser vanes 264 disposed about a plurality of rotating compressor blades 266. In this example, the microgas turbine engine 230 is about 12 millimeters in diameter and about 3 millimeters in thickness and employs an air inlet 268 defining an area of about 1 $mm^2$. By way of exemplary operation, air A enters the microgas turbine engine 230 along a central line L defined through the inlet 268. As shown, the air A turns radially outward and is compressed in a centrifical, planar microcompressor described below. Although only one air path A is apparent in FIG. 4 for clarity, the skilled artisan will appreciate that a continuous air path exists around a circumference of the microengine 230 and through its various components as more clearly shown in FIG. 5.

FIGS. 4 and 5 further show that the microcompressor includes a compressor rotor disk 270 that is approximately 4 millimeters in diameter in this example and has radial-flow rotor blades 266, which are about 250 micrometers in this example. As shown, the compressor rotor disk 270 is connected to a shaft 272 that is radially journaled for spinning, which in turn spins the compressor rotor disk 270 and the blades 266. Also shown, the plurality of stationary diffuser vanes 264 is located just beyond a radial periphery of the compressor rotor disk 270. Thus, the air A passing through the compressor rotor blades 266 exits the rotor with a large angular momentum that is removed by the vanes 264 in the diffuser and converted to a static pressurize.

More specifically, fuel (not shown) is injected at the discharge of the compressor rotor disk 270 by way of a fuel injector 274, which is formed of a circular array of, e.g., about 100-200 fuel-metering orifices on the microengine housing 263. As shown, the injected fuel mixes with the air A while flowing radially outward. The fuel injectors 274 are supplied by, e.g., an annular supply plenum 276 that is connected to an external fuel tank such as the fuel cartridge 34 described above.

The air-fuel mixture of FIG. 4 traverses a diffuser region and then turns (indicated by the letter T) through about 90° to axially traverse a periphery of small holes; i.e., the combustor inlet ports 278 that define flame holders provided in the region between the ports 278. A plurality of combustion igniters 280, e.g., resistive heaters controlled to the auto-ignition temperature of the air-fuel mixture, are located at a number of the combustion inlet ports to initiate combustion of the air-fuel mixture. The ignited mixture axially enters an annular microcombustion chamber 236 where the mixture is fully combusted. In this example, the microcombustion chamber 236 is between about 2 millimeters-10 millimeters in annular height and between about 0.5 millimeters-5.5 millimeters-long measured axially.

FIGS. 4 and 5 further show that the expanding exhaust gases from the microcombustion chamber 236 are discharged radially inward through stationary turbine guide vanes 282 to a planar radial inflow microturbine rotor disk 284. The turbine rotor disk 284 diameter can be substantially similar to that of the compressor rotor disk 270. Like the microcompressor, the turbine rotor disk 284 includes axial blades 286 similar in height to those of the compressor rotor 270. As shown, the turbine disk 284 is connected by way of the journaled shaft 272 to the compressor disk 270 and thus rotationally drives the microcompressor in response to combustion gases exhausted through the microturbine blades that cause the turbine disks to spin. Specifically, as discussed above, the microturbine is exhausted radially inward where the exhaust gas then turns T' axially, leading the microengine 262 through an exhaust nozzle 288. Thus, the turbine rotor disk 284 can operate as a microgenerator for driving power electronics via the power line P that in turn drives an electrical load such as the resistor elements 18*a-x* introduced above.

Figure 6:
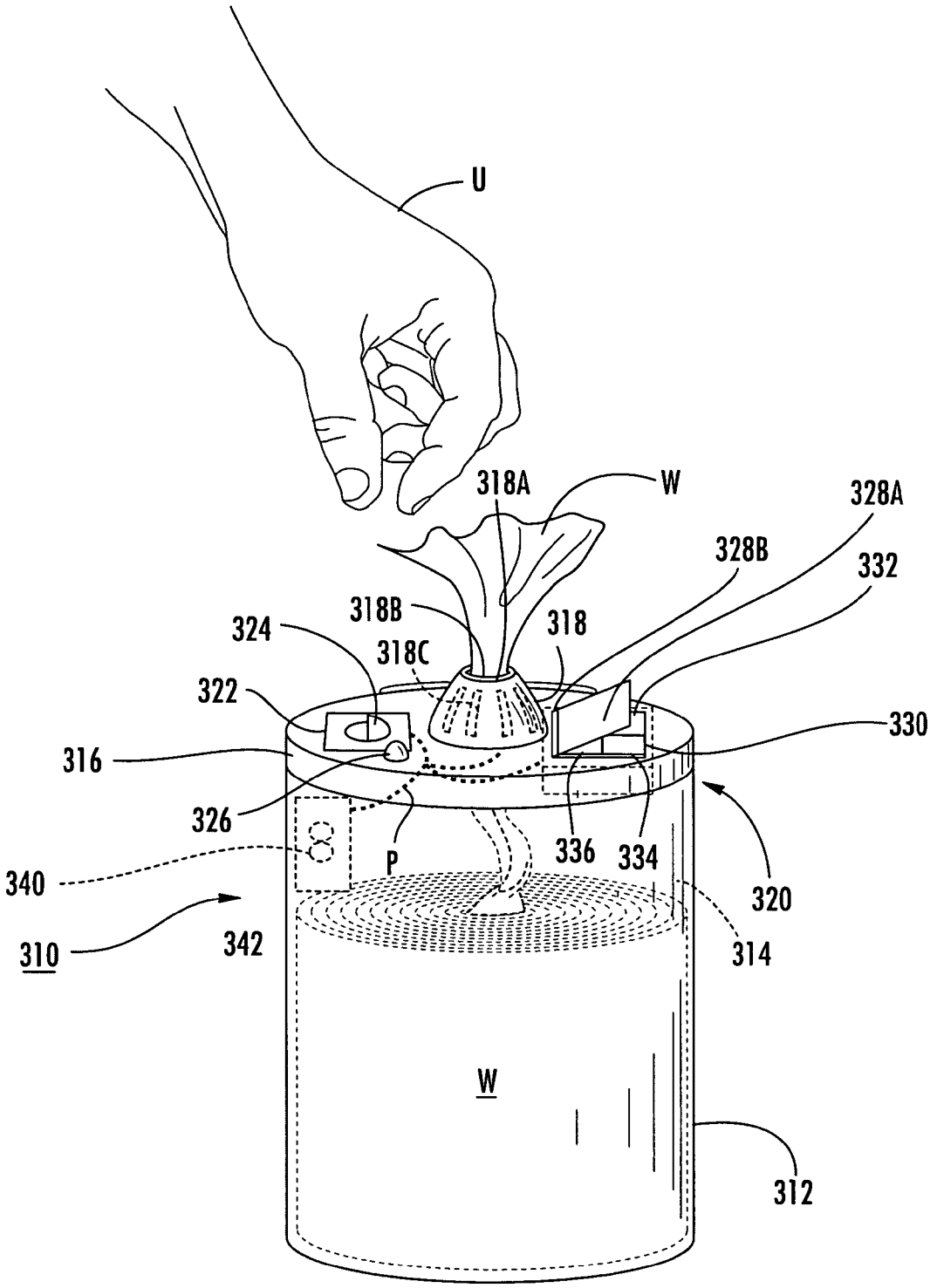
FIG. 6 is a perspective view of a micro powered dispenser with some elements shown in phantom for clarity according to another embodiment of the invention.

FIG. 6 shows another embodiment of the present invention in which the briefly introduced warming container or tub 310 holds a plurality of wipes W (shown here in phantom for clarity). Some components and elements of the warming container 310 are similar to the foregoing embodiments and only some aspects of the present embodiment are discussed for brevity. Reference is therefore made to the foregoing embodiments to enable the skilled artisan to practice similar components and elements in the present embodiment.

As shown in FIG. 6, the warming container 310 includes a body 312 having a cap or lid 316 upon which a heating channel 318 is formed or attached. As shown, the cap 316 further includes a controller 322 and a door or flap 328A under which a micro power source 320 is housed. In this aspect of the invention, the wipes W are retrieved through a nozzle 318A formed about the heating channel 318. For example, the wipes W are dispensed through an orifice 318B defined in the nozzle 318A in a pop-up fashion; i.e., one at a time and heated through the heating channel 318.

While preferred embodiments of the invention have been shown and described, those skilled in the art will recognize that other changes and modifications may be made to the foregoing embodiments without departing from the spirit and scope of the invention. For example, specific fuels described above and various devices and their shapes and materials and placement can be modified to suit particular applications. It is intended to claim all such changes and modifications as fall within the scope of the appended claims and their equivalents.

That which is claimed is:

1. A warming dispenser, comprising:

a housing defining a compartment therein, the compartment being configured to hold a plurality of sheets;

a heating device disposed on and in direct contact with and movable with respect to at least the uppermost of the plurality of sheets;

a micro power source comprising a micro-fuel cell having a fuel cartridge and a combustion chamber, the fuel cartridge being configured to hold a supply of fuel, the combustion chamber being configured to receive and combust the fuel to generate energy; and a controller in communication with the micro power source, the controller being configured to repeatedly activate and deactivate the micro power source, the heating device being configured to deliver the energy for warming at least one of the sheets.

2. The warming dispenser as defined in claim 1, wherein the sheets are selected from the group consisting of a tissue, a wipe, a non-woven polymer material, an airlaid material, and combinations thereof

3. The warming dispenser as defined in claim 1, wherein the sheets are selected from the group consisting of wet sheets, dry sheets, treated sheets, and combinations thereof.

4. The warming dispenser as defined in claim 1, wherein the heating device is a plate adapted for selectively heating the sheets disposed proximate the plate.

5. The warming dispenser as defined in claim 4, wherein the plate has a plurality of resistor elements attached thereto, the micropower source configured to deliver electricity to the resistor elements for resistive heating to heat the plate.

6. The warming dispenser as defined in claim 1, further comprising a hinge assembly connecting a portion of the plate to a complementary portion of the compartment, the hinge assembly being configured to rotate the plate away from the at least one heated sheet for removal of the heated sheet by a user.

7. The warming dispenser as defined in claim 1, wherein the micro power source is configured to generate about 0.2 W to about 200 W.

8. The warming dispenser as defined in claim 7, wherein the source of fuel is adapted for generating an electrochemical reaction to generate the energy.

9. The warming dispenser as defined in claim 7, wherein the fuel cartridge is configured to be refillable with a replacement source of fuel.

10. The warming dispenser as defined in claim 7, wherein the fuel cartridge is a replaceable fuel cartridge.

11. The warming dispenser as defined in claim 1, wherein the micro power source is a microturbine engine including a plurality of diffuser vanes and a plurality of compressor blades, the plurality of compressor blades being configured for rotation about the diffuser vanes to generate the energy.

12. The warming dispenser as defined in claim 1, wherein the controller is a conductivity contact being configured to activate the micro power source by a user touch.

13. The warming dispenser as defined in claim 1, further comprising an indicator being configured to alert the user to a status of the micro power source.

14. The warming dispenser as defined in claim 1, further comprising an indicator being configured to alert the user to a temperature of the heating device.

15. The warming dispenser as defined in claim 14, further comprising an indicator being configured to alert the user to a status of the micro power source.

16. The warming dispenser as defined in claim 14, further comprising an indicator being configured to alert the user to a temperature of the heating plate.

17. The warming dispenser as defined in claim 14, further comprising a lid attached to the housing being configured to cover the heating plate.

18. A warming dispenser, comprising:

a housing defining a compartment therein, the compartment being configured to hold a plurality of sheets;

a heating plate disposed on and in direct contact with and movable with respect to at least the uppermost of the plurality of sheets;

a micro power source comprising a micro-fuel cell that has a fuel cartridge and a combustion chamber, the fuel cartridge being configured to hold a supply of fuel, the combustion chamber being configured to receive and combust the fuel to generate energy in communication with the heating plate; and a controller in communication with the micro power source, the controller being configured to repeatedly activate and deactivate the micro power source, the heating plate having a plurality of resistor elements therein being configured to convert the energy to heat for warming at least one of the sheets, the heating plate being configured for removal from the compartment to access the at least one heated sheet.

19. The warming dispenser as defined in claim 18, wherein the sheets are selected from the group consisting of a tissue, a wipe, a non-woven polymer material, an airlaid material, and combinations thereof.

20. The warming dispenser as defined in claim 18, wherein the sheets are selected from the group consisting of wet sheets, dry sheets, treated sheets, and combinations thereof.

21. The warming dispenser as defined in claim 18, further comprising a hinge assembly connecting a portion of the plate to a complementary portion of the compartment, the hinge assembly being configured to rotate the plate away from the at least one heated sheet for removal of the heated sheet by a user.

22. The warming dispenser as defined in claim 18, wherein the micro power source is configured to generate about 0.2 W to about 200 W.

23. The warming dispenser as defined in claim 18, wherein the supply of fuel is adapted for generating an electrochemical reaction to generate the energy.

24. The warming dispenser as defined in claim 18, wherein the fuel cartridge is configured to be refillable with a replacement supply of fuel.

25. The warming dispenser as defined in claim 18, wherein the fuel cartridge is a replaceable fuel cartridge.

26. The warming dispenser as defined in claim 18, wherein the micro power source is a microturbine engine including a plurality of diffuser vanes and a plurality of compressor blades, the plurality of compressor blades being configured for rotation about the diffuser vanes to generate the energy.

27. The warming dispenser as defined in claim 18, wherein the controller is a conductivity contact being configured to activate the micro power source by a user touch.

* * * * *